US005493813A

United States Patent [19]

Vetter et al.

[11] Patent Number: 5,493,813

[45] Date of Patent: Feb. 27, 1996

[54] SELECTIVELY DRIVABLE WINDOW OPERATOR

[75] Inventors: Gregory J. Vetter; Stephen M. Piltingsrud, both of Owatonna, Minn.

[73] Assignee: Truth Hardware Corporation, Owatonna, Minn.

[21] Appl. No.: 100,358

[22] Filed: Aug. 2, 1993

[51] Int. Cl.[6] ..... E05F 11/24

[52] U.S. Cl. ..... 49/341; 49/139; 49/340; 475/339

[58] Field of Search ..... 49/334, 340, 341, 49/139, 140; 475/331, 338, 339, 346

[56] References Cited

U.S. PATENT DOCUMENTS

| | | | |
|---|---|---|---|
| 2,931,252 | 4/1960 | Ferguson et al. | 475/338 |
| 3,156,136 | 11/1964 | Sogabe | 475/339 |
| 3,874,117 | 4/1975 | Boehm | 49/340 X |
| 4,136,578 | 1/1979 | Van Klompenburg . | |
| 4,196,889 | 4/1980 | Dudek | 254/186 R |
| 4,241,541 | 12/1980 | Van Klompenburg et al. . | |
| 4,253,276 | 3/1981 | Peterson et al. . | |
| 4,266,371 | 5/1981 | Erdman et al. . | |
| 4,305,228 | 12/1981 | Nelson . | |
| 4,317,343 | 3/1982 | Gerry | 68/23.7 |
| 4,346,372 | 8/1982 | Sandberg . | |
| 4,497,135 | 2/1985 | Vetter . | |
| 4,521,993 | 6/1985 | Tacheny et al. . | |
| 4,553,656 | 11/1985 | Lense | 49/140 X |
| 4,617,758 | 10/1986 | Vetter . | |
| 4,823,508 | 4/1989 | Allen . | |
| 4,840,075 | 6/1989 | Tucker . | |
| 4,843,703 | 7/1989 | Nolte et al. . | |
| 4,845,830 | 7/1989 | Nolte et al. . | |
| 4,894,902 | 1/1990 | Tucker . | |
| 4,937,976 | 7/1990 | Tucker et al. . | |
| 4,938,086 | 7/1990 | Nolte et al. . | |
| 4,945,678 | 8/1990 | Berner et al. . | |
| 5,054,239 | 10/1991 | Tucker et al. . | |
| 5,139,468 | 8/1992 | Churchill et al. | 475/324 |
| 5,152,103 | 10/1992 | Tucker et al. . | |
| 5,199,216 | 4/1993 | Vetter et al. . | |
| 5,269,734 | 12/1993 | Menge | 475/339 |
| 5,313,737 | 5/1994 | Midas | 49/340 X |
| 5,366,423 | 11/1994 | Mori et al. | 475/338 X |

FOREIGN PATENT DOCUMENTS

| | | | |
|---|---|---|---|
| 92 | 1/1980 | WIPO | 49/139 |

*Primary Examiner*—Blair M. Johnson
*Assistant Examiner*—Jerry Redman
*Attorney, Agent, or Firm*—Wood, Phillips, VanSanten, Clark & Mortimer

[57] ABSTRACT

A window operator including a first sun gear, a first drive gear including a drive gear portion and a ring gear portion, a manual worm drive operatively connected to the drive gear portion, a planetary gear carrier, a first set of planetary gears carried between the first sun gear and the ring gear portion, and an operable connection between the gear carrier and a window sash whereby pivoting of the gear carrier operates the sash. A first ring gear is drivably connected to pivot with the first sun gear, and a second ring gear is fixed with respect to the window frame. A second set of planetary gears has first and second axially spaced gear segments, the first gear segments being disposed between a motor driven sun gear and one of the ring gears, and the second gear segments drivably engaging the other of the ring gears. The ring gears and/or the gear segments have different numbers of teeth. The worm drive lies in substantially the same plane as the drive gear, and is hidden by the window frame except for a female socket aligned with the worm axis and exposed through an opening in the frame. A handle is provided with a male connector selectively extendable through the frame opening to operatively engage the worm female socket. The gears are made of an inherently corrosion resistant non-metallic material such as plastic.

49 Claims, 3 Drawing Sheets

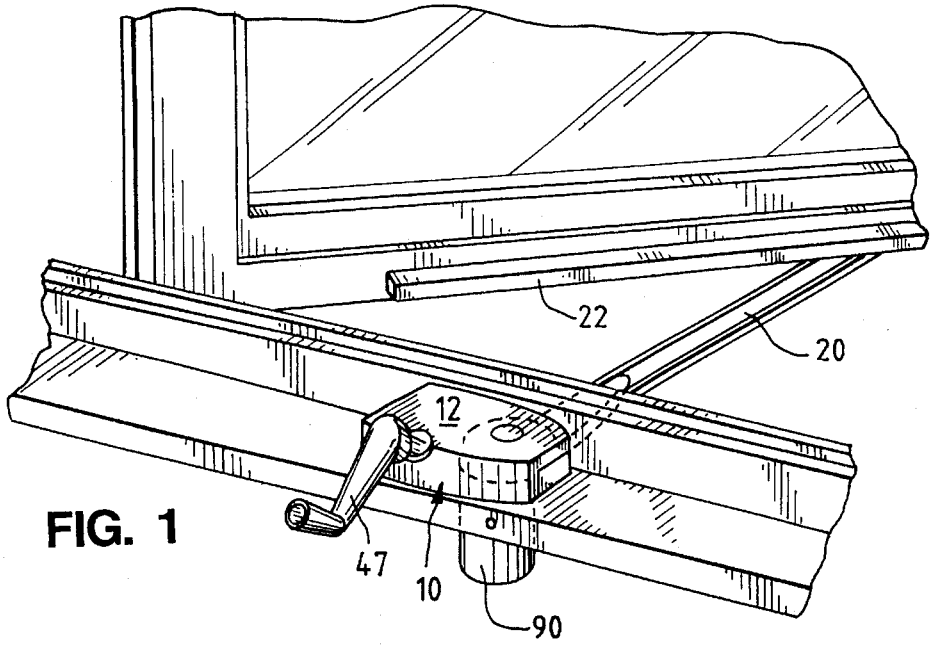
FIG. 1
FIG. 2
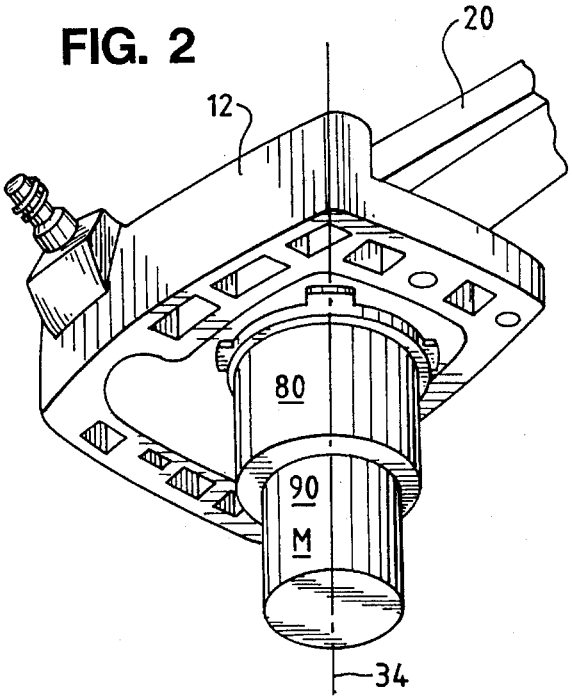
FIG. 3
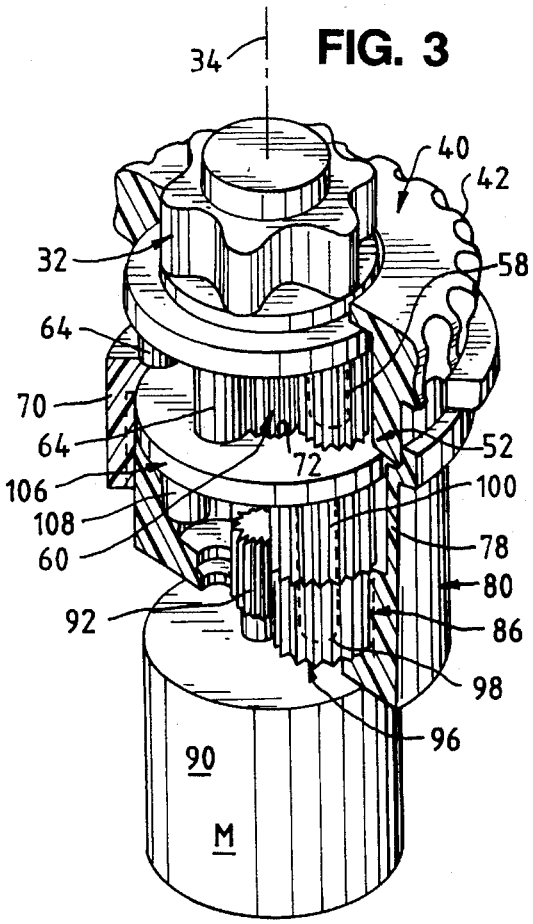

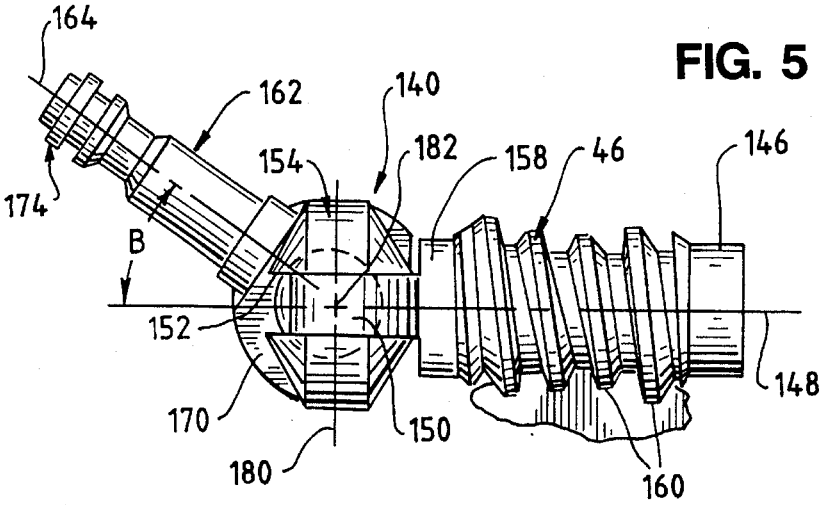
FIG. 5
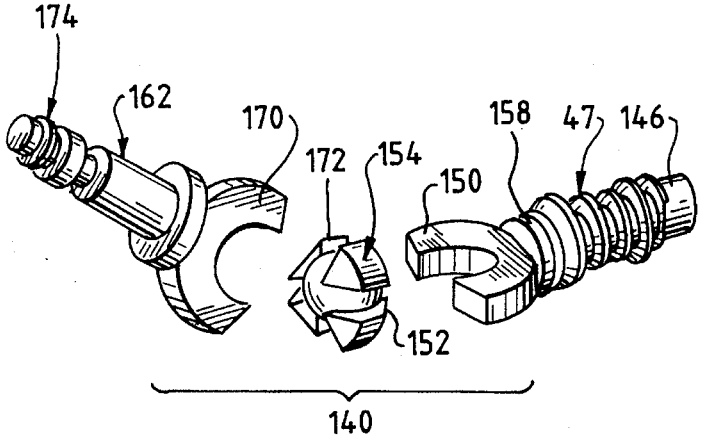
FIG. 6
FIG. 7
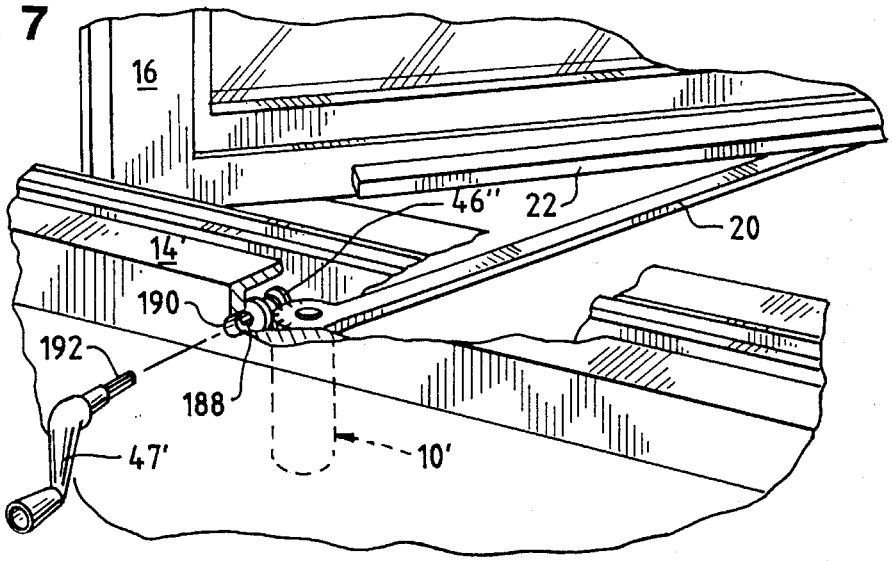

SELECTIVELY DRIVABLE WINDOW OPERATOR

BACKGROUND OF THE INVENTION

1. Technical Field

The present invention is directed toward window operators, and more particularly toward window operators which may be selectively motor driven or manually driven.

2. Background Art

There are, of course, any number of different types of window (and other closure) operators which are well known in the art. Examples of such operators are shown, for example, in Van Klompenburg U.S. Pat. No. 4,136,578, Van Klompenburg et al. U.S. Pat. No. 4,241,541, Peterson et al. U.S. Pat. No. 4,253,276, Erdman et al. U.S. Pat. No. 4,266,371, Nelson U.S. Pat. No. 4,305,228, Sandberg U.S. Pat. No. 4,346,372, Vetter U.S. Pat. No. 4,497,135, Tacheny et al. U.S. Pat. No. 4,521,993, Vetter U.S. Pat. No. 4,617,758, Allen U.S. Pat. No. 4,823,508, Tucker U.S. Pat. No. 4,840,075, Nolte et al. U.S. Pat. No. 4,843,703, Nolte et al. U.S. Pat. No. 4,845,830, Tucker U.S. Pat. No. 4,894,902, Tucker et al. U.S. Pat. No. 4,937,976, Nolte et al. U.S. Pat. No. 4,938,086, Berner et al. U.S. Pat. No. 4,945,678, Tucker et al. U.S. Pat. No. 5,054,239, Tucker et al. U.S. Pat. No. 5,152,103, and Vetter et al. U.S. Pat. No. 5,199,216.

Generally speaking, such operators have used a variety of linkages in combination with suitable hinge structures, where the operator linkages are actuated by rotation of a manual or powered drive connected to the linkage through assorted worm gear drives.

Design of acceptable operators is difficult due to numerous, sometimes contradictory, requirements. For example, it is necessary to provide operators which are able to withstand the extremely high loads often encountered by operators (when, for example, breaking the weatherstrip seal during initial opening of the sash and when closing the window sash to seal about the entire periphery of the weather strip).

Notwithstanding these strength requirements, it has been aesthetically necessary to minimize the size of operators in order to minimize the intrusion of the operator into the open viewing area provided through the pane opening of the sash.

The strength requirements have also heretofore necessitated the use of high strength, and relatively costly, materials (such as suitably hardened metals) in the drive train of the operator. Such materials are inherently susceptible to corrosive environments such as are commonly found in many areas, particularly in seaside dwellings. In order to provide a long useful life for the operator, various attempts have been made to coat or treat the metal components to resist corrosion. However, even the most successful of such treatments can significantly increase the cost of manufacturing the operator.

Yet another requirement in many window operator installations is the ability to drive the operator by an electric motor. However, since such motors are required to overcome the previously discussed high loads typically encountered by such operators, relatively expensive high power motors have typically been required. Of course, use of these motors in high load conditions also makes them susceptible to early burn out, in which case they provide neither the low cost nor the long useful life required in such units.

Prior art operators have to varying degrees been unable to address all of the above design constraints in a suitable manner.

The present invention is directed toward overcoming one or more of the problems set forth above.

SUMMARY OF THE INVENTION

In one aspect of the present invention, an operator for controlling movement of a window sash relative to a window frame is provided, including a first sun gear, a first drive gear including a drive gear portion and a ring gear portion, a first drive input operatively connected to the drive gear portion, a planetary gear carrier, a first set of planetary gears between the first sun gear and the ring gear portion of the first drive gear and pivotable about the axes defined by the carrier, and an operable connection between the gear carrier and the window sash whereby pivoting of the gear carrier operates the sash.

In a second aspect of the present invention, an operator for controlling movement of a window sash relative to a window frame is provided, including a first ring gear drivably connected to the window sash whereby pivoting of the first ring gear operates the sash, a second ring gear fixed with respect to the window frame, a selectively driven sun gear, and a set of planetary gears having first and second axially spaced gear segments, the first gear segments being disposed between the sun gear and one of the ring gears, and the second gear segments drivably engaging the other of the ring gears. The ring gears and/or the gear segments have different numbers of teeth.

In a third aspect of the present invention, the first two aspects of the present invention are combined, with the first ring gear being secured to pivot with the first sun gear, whereby the selectively driven sun gear is driven by a motor and the first drive input is a manual drive.

In a fourth aspect of the present invention, a hidden operator for controlling movement of a window sash relative to a window frame is provided, including a drive gear pivotable about a central axis substantially perpendicular to one side of the window frame, the drive gear being mountable to the one side of the window frame in a position hidden by the window frame. A worm drivably engages the drive gear in a position hidden by the window sill, the worm being pivotable about an axis which defines a plane which is substantially perpendicular to the central axis and including a female socket aligned. with the worm axis and exposed through an opening in the frame. A handle is provided with a male connector selectively extendable through the frame opening to operatively engage the worm female socket.

In a fifth aspect of the present invention, the gears are made of an inherently corrosion resistant non-metallic material such as plastic.

It is an object of the invention to provide a window operator which may be simply and inexpensively manufactured and installed.

It is another object of the invention to provide a window operator which may be simply and reliably operated over a long useful life.

It is a further object of the present invention to provide an operator which is highly resistant to corrosion in the different types of environments commonly encountered by dwellings.

It is still another object of the present invention to minimize the visual intrusion of the operator into the open viewing area provided through the pane opening of the sash.

It is a still further object of the present invention to provide an operator which can be selectively driven by either of two drive inputs, as by a conventional manually operated handle and an electric motor.

It is another object of the present invention to maximize the useful life of any electric motor used to control the operator notwithstanding the high loads typically incurred by the operator.

BRIEF DESCRIPTION OF THE DRAWINGS

FIG. 1 is a perspective broken view of a window including an operator embodying the present invention;

FIG. 2 is a bottom perspective view of the operator shown in FIG. 1;

FIG. 3 is a perspective, partially broken view of the internal drive components of the operator shown in FIG. 2;

FIG. 5 is a side view of a portion of one manual drive usable with the present invention, with the drive gear illustrated in a plane shifted 90 degrees from actual to best illustrate the meshing of the worm and drive gear;

FIG. 6 is a perspective exploded view of the manual drive shown in FIG. 5; and FIG. 7 is a perspective broken view of a window including an operator embodying the present invention and using a different manual drive.

DESCRIPTION OF THE PREFERRED EMBODIMENT

Figure 4:
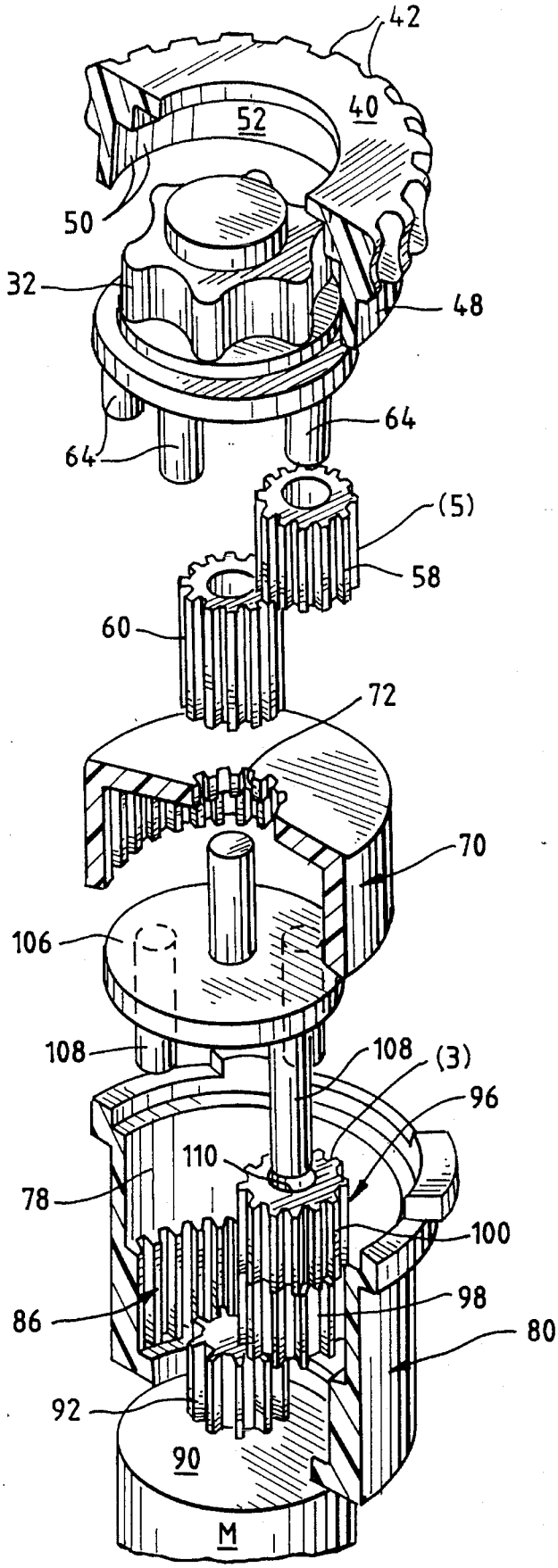
FIG. 4 is an exploded, partially broken view of the internal drive components of the operator shown in FIG. 3.

A first embodiment of the window operator 10 of the present invention is shown in FIGS. 1–6.

The window operator 10 includes a base 12 suitably mounted to a window frame 14 to which a suitable window sash 16 is secured.

With the particular embodiment shown, the operator 10 includes a single arm 20 having a roller (not shown) on its end, which roller is received in a track 22 secured to the sash 16. A suitable hinge (not shown) is mounted between the window frame 14 and the window sash 16 to define the relative movement between the frame 14 and sash 16. The single arm operator shown in the Figures moves the sash 16 by pivoting the arm 20 to exert a force on the sash 16 through the connection of the roller and the track 22. Such basic operation is known in the art.

As will become apparent from this disclosure, the connection between the gear drive of the operator and the window sash may, however, be of virtually any type wherein operation involves pivoting of a link relative to the window frame, with the pivoted link acting to move the sash in some path. Thus, once an understanding of the present invention is obtained, it will be recognized that the present invention may be readily incorporated in window operators using still other link connections between a pivoting drive and the window sash, including the various different link configurations used in operators shown in Van Klompenburg et al. U.S. Pat. No. 4,241,541, Peterson et al. U.S. Pat. No. 4,253,276, Erdman et al. U.S. Pat. No. 4,266,371, Nelson U.S. Pat. No. 4,305,228, Sandberg U.S. Pat. No. 4,346,372, Vetter U.S. Pat. No. 4,497,135, Tacheny et al. U.S. Pat. No. 4,521,993, Vetter U.S. Pat. No. 4,617,758, Allen U.S. Pat. No. 4,823,508, Tucker U.S. Pat. No. 4,840,075, Nolte et al. U.S. Pat. No. 4,843,703, Nolte et al. U.S. Pat. No. 4,845,830, Tucker U.S. Pat. No. 4,894,902, Tucker et al. U.S. Pat. No. 4,937,976, Nolte et al. U.S. Pat. No. 4,938,086, Berner et al. U.S. Pat. No. 4,945,678, Tucker et al. U.S. Pat. No. 5,054,239, Tucker et al. U.S. Pat. No. 5,152,103, and Vetter et al. U.S. Pat. No. 5,199,216, the disclosures of which relating to the connection of a pivoting drive to a window sash are all hereby incorporated by reference.

The operator arm 20 is suitably secured for pivoting with a gear carrier 32 about the central axis 34 of the operator 10.

A manual drive gear 40 includes outer teeth 42 which mesh with a suitable manual input worm 46. An input worm 46 is suitably connected (as hereafter described) to a manually engageable member such as a handle 47 (see FIG. 1) which may be grasped by a person to manually rotate the input worm 46.

The manual drive gear 40 also includes a downwardly depending annular flange 48 with teeth 50 about its inner periphery defining a ring gear section 52. The ring gear section 52 meshes with planetary gears 58 disposed about a first sun gear 60. The planetary gears 58 are pivotable about downwardly depending axial members 64 spaced about the gear carrier 32.

The first sun gear 60 is suitably secured for rotation with a second ring gear 70. For example, in the embodiment shown in FIGS. 3 and 4, the sun gear 60 has an axial height greater than the planetary gears 58, with a portion of the sun gear 60 extending into a toothed central opening 72 in the second ring gear 70.

The second ring gear 70 is pivotally received in an annular section 78 of the gear housing 80, which is suitably fixed relative to the window frame 14. Axially spaced below the housing annular section 78 is a ring gear section 86 having an inner diameter substantially equal to the inner diameter of the second ring gear 70.

A drive motor 90 is mounted at the bottom of the housing 80 and includes an output shaft (not seen) which rotates a sun gear 92 centrally located at the bottom of the housing 80.

Disposed about the sun gear 92 are planetary gears 96 each having a lower segment 98 and an upper segment 100. The planetary gear lower segments 98 engage the sun gear 92 and are axially spaced below the second ring gear 70 (so as to not mesh with the ring gear 70). The upper segments 100, which are differently configured from the lower segments 98 as detailed further below, are axially spaced above the sun gear 92 and engage only the second ring gear 70 (but not the sun gear 92).

A second gear carrier 106 having downwardly depending axial members 108 is preferably disposed within, and rotatable with respect to, the second ring gear 70. The axial members 108 are received in central openings 110 in the planetary gears 96 to ensure proper orientation of the planetary gears 96 within the housing 80.

The upper and lower segments 98, 100 of the planetary gears 96, the housing ring gear section 86, and the second ring gear 70 are all relatively configured so as to permit substantial gear reduction from the drive motor 90, as will become apparent from the below discussion of the operation of this operator 10. Specifically, in the configuration shown in the Figures, the housing ring gear section 86 and the second ring gear 70 have the same number of teeth and the same diameter, whereas the upper and lower planetary gear segments 98, 100 have the same diameter but different numbers of teeth. Different numbers of teeth between the ring gear 70 and ring gear section 86 and/or between the upper and lower planetary gear segments 98, 100 can be selected to provide the desired gear reduction, including reductions of over 1000 to 1 (whereby 1000 revolutions of the drive motor output shaft would rotate the second ring gear 70 only one time).

In a preferred embodiment, the ring gear 70 and ring gear section 86 have different numbers of teeth as do the upper planetary gear segments 98 and the lower planetary gear segments 100. Still further, it is preferred that the ring gear section 52 and ring gear section 86 have the same pitch diameter for a purpose described hereafter.

The operator 10 may thus be driven either manually or by motor as desired. For example, the operator 10 could normally be driven by the motor 90 as described below, with the manual drive used at selected times such as power outages or when simply more convenient.

Motor driving of the operator 10 is accomplished as follows.

The motor 90 is selectively activated to rotate the sun gear 92. Rotation of the sun gear 92 causes the lower segments 98 of the planetary gears 96 to circle about the central axis 34 while at the same time rotating about their own axes.

The upper segments 100 of the planetary gears 96 circle and rotate at the same rate as the lower segments 98. Due to the different numbers of gear teeth between the ring gear 70 and ring gear section 86 and/or between the upper and lower planetary gear segments 98, 100 as previously described, the upper segment 100 will cause the second ring gear 70 to rotate relatively slowly about the central axis 34, with the first sun gear 60 rotating with the second ring gear 70 due to the connection through the toothed central opening 72.

Rotation of the sun gear 60 causes the planetary gears 58 to circle about the central axis 34 and therefore pivot the gear carrier 32 through the connection to its downwardly depending axial members 154. The gear carrier 32 pivots the connected operator arm 20 to control movement of the sash 16 in a suitable manner as previously discussed.

It should be understood that the forces exerted by the planetary gears 58 on the ring gear section 52 of the manual drive gear 40 will not turn the drive gear 40 so that the above operation occurs. That is, the rotary force which the planetary gears 58 exert on the drive gear 40 applies an essentially axial force on the input worm 46. Due to the small pitch of the thread of the worm 46, the vast majority of that axial force tends to frictionally bind the gear 40 and worm 46 against pivotal movement.

Of course, due to the great gear reduction which is possible with the above described operation, the motor 90 does not incur high loads despite the high loads which can be incurred by the operator arm 20.

Manual driving of the operator 10 is accomplished as follows.

The input worm 46 is manually pivoted to rotate the drive gear 40. Rotation of the drive gear 40 and its ring gear section 52 causes the planetary gears 58 to circle around the sun gear 60 by pivoting about their own axes.

In manual operation, it should be understood that the forces exerted by the planetary gears 58 on the sun gear 60 will not turn the sun gear 60 in the preferred embodiment in which the ring gear section 52 and ring gear section 86 have the same pitch diameter. In such a configuration, the rotational forces within the drive tend to oppose and counterbalance one another to thereby prevent manual operation from significantly turning the sun gear 60 rather than the gear carrier 32. It should also be understood, however, that in other embodiments of the present invention, other structures could be suitably used to prevent backdrive of the motor 90 during manual operation.

Accordingly, the circling of the planetary gears 58 about the central axis 34 pivots the gear carrier 32 through the connection to its downwardly depending axial members 64, and the gear carrier 32 pivots the connected operator arm 20 to control movement of the sash 16 in a suitable manner as previously discussed.

Alternative preferred manual drives are shown in FIGS. 5–7, where the input worm 46 is oriented with its axis substantially parallel to the plane in which the drive gear 40 pivots.

A first preferred manual drive input 140 usable in the FIG. 1 installation is shown in FIGS. 5–6, which drive input may be used in conventional installations such as shown in FIG. 1, with the pivot axis of the handle 47 being at an angle β from the horizontal plane, where β is on the order of 35 degrees. Such an angle permits the drive handle 47 to be easily operated with minimal intrusion into the room. That is, if the axis of the drive input were vertical, the person rotating the handle would likely bang their knuckles against the sash. Alternatively, if the axis were horizontal, the handle would project into the room from the frame and thus could be damaged when bumped, or could damage something which bumped into it, and could further be ergonomically difficult to rotate at typically low window heights.

This drive input includes an enveloping worm 46 suitably secured to the base 12 at one end 146 for pivoting about a substantially horizontal axis 148. The other end of the worm 46 is forked 150 and received in an annular slot 152 of a connecting ball 154. The worm 46 is also preferably also secured to the base 12 at a cylindrical section 158 adjacent to the forked end 150 for pivoting about the horizontal axis 148.

The worm 46 includes a helical thread 160 having a variable height whereby the peaks of the thread 160 lie in an annular orientation substantially conforming to the annular orientation of the engaged gear 40, whereby the engaging surfaces between the worm 46 and the gear 40 may be maximized and the stress along those surfaces minimized. As a result of these minimized stresses, the worm 46 and gear 40 may be made of low cost and corrosion resistant plastic while still being able to withstand the high loads often encountered by window operators.

A drive input shaft 162 is also suitably mounted to the base 12 for rotation about an axis 164 which intersects the horizontal axis 148 at an angle β (with the point of intersection of the axes 148, 164 being at the center of the ball 154) to preferably define a vertical plane. The input shaft 162 includes a forked end 170 received in a second annular slot 172 in the connecting ball 154. The opposite end 174 of the input shaft 162 is adapted for connection to a handle or a motor drive such as is known in the art.

The two slots 152, 172 are centered about radii 180, 182 of the ball 154 which are preferably oriented at right angles relative to one another. Therefore, the ball 154 and worm 46 pivot relative to one another about one of the radii 180 and the ball 154 and the input shaft 162 pivoting relative to one another about the other of the radii 182.

Continuous rotation of the worm 44 and input shaft 62 is thus permitted about a full 360 degree range, with the motion of the connecting ball 54 being somewhat complex but best defined by two factors: the worm forked end pivot radius 180 pivots in a vertical plane and the input shaft forked end pivot radius 182 pivots in a plane which is oriented at an angle of β relative to the vertical plane.

The above described drive input is also described in a pending U.S. Patent Application filed by Stephen M. Piltingsrud on Jul. 20, 1993 as Ser. No. 08/095,054, entitled "Window Operator", the disclosure of which is hereby incorporated by reference.

A second preferred alternative drive is illustrated in FIG. 7, which uses a worm 46' substantially similar to the above discussed worm 46, except that it includes an axially aligned female drive 188. This structure thus allows substantially all of the operator 10' to be vimally hidden from the interior of the room by the window frame 14' and wall, with the end of the female drive 188 only exposed through a circular opening 190 in the frame 14'. A suitable handle 47' with a male connector 192 receivable in the female drive 188 is provided so that the manual drive input may be used if necessary. The handle 47' may otherwise be generally hidden away in a drawer of the like so that there is virtually no intrusion by the operator 10' into the aesthetic appearance of the window.

Operators embodying various aspects of the present invention thus can have numerous advantages over prior art window operators.

Operators made according to the present invention are readily adaptable for use with electric drive motors, such types of drive becoming more prevalent in today's market using hand held remote controls and central computer systems to control all window and skylight operators in conjunction with door and window locks. In particular, because of the high gear railos which can be obtained with such drives, inexpensive high speed low power motors may be easily used for such powered drives.

Further, because of the large number of engaged teeth between gears at all configurations of the drive, the gears themselves may be made of low cost plastic while still maintaining the ability to withstand high loads when creating or breaking the weatherstrip seal. Such plastic gearing permits cost savings over the precision metal components typically now required in operator drives. Further, since such plastic materials are inherently resistant to corrosive environments such as found at seashores and elsewhere, operators made according to the present invention will be highly durable and therefore provide reliable service over the many years of expected useful life without requiring any expensive or marginally effective corrosion resistance treatments.

Still further, the operator 10 of the present invention permits selective use of either manual or motor drives depending on the needs of the person. Automatic operation by an electric motor has certain obvious advantages, not only in convenience but also in ensuring proper operation when needed (such as, for example, automatic operation responsive to detection of rain by suitable environmental sensors). Nevertheless, motor driven operators also need manual overrides so that the operators can be used to move the window sash when, for example, there is a power outage, or at times when it is simply more convenient for the person to do so.

Of course, the operator 10' as described above can provide both motor and manual drives with virtually no visual intrusion into the aesthetics of the window opening. Given the aesthetic importance of most windows in architecture today, the ability to provide this ideal functionality without detracting from the appearance of the windows is highly desirable.

In addition, it should by now be recognized that the above described operators may be easily and thus inexpensively assembled by simply placing the components into the housing in layers and then snapping the housing shut to retain the components in the desired position.

Still other aspects, objects, and advantages of the present invention can be obtained from a study of the specification, the drawings, and the appended claims.

We claim:

1. An operator for controlling movement of a window sash relative to a window frame, comprising:

a first sun gear having a central axis fixed with respect to the window frame;

a first drive gear pivotable about the central axis, said first drive gear including a drive gear portion and a ring gear portion;

a first drive input operatively connected to the drive gear portion;

a planetary gear carrier including means defining planetary gear axes spaced about the first sun gear and the central axis;

a first set of planetary gears between said first sun gear and the ring gear portion of said first drive gear and pivotable about the gear axes defined by the gear carrier; and means for drivably connecting the gear carrier to the window sash whereby pivoting of the gear carrier operates the sash.

2. The operator of claim 1, further comprising a second drive input operatively connected to the first sun gear for selectively rotating the first sun gear.

3. The operator of claim 2, wherein said second drive input comprises a motor drivably connected to the first sun gear.

4. The operator of claim 3, wherein the first drive input is manually operable.

5. The operator of claim 4, wherein the first drive input comprises a manually rotatable handle operatively connected to the drive gear portion to rotate the gear portion in response to rotation of the handle.

6. The operator of claim 2, wherein the operative connection between the second drive input and the sun gear comprises:

a second ring gear secured for pivoting with the first sun gear;

a second sun gear selectively rotatable about said central axis by said second drive input; and a second set of planetary gears between said second sun gear and said second ring gear.

7. The operator of claim 6, wherein said second drive input comprises a motor drivably connected to the second sun gear.

8. The operator of claim 6, wherein said first ring gear and said second ring gear have substantially equal pitch diameters.

9. The operator of claim 6, further comprising a third ring gear fixed about said central axis, wherein said second set of planetary gears include first and second axially spaced gear segments, the first gear segments being disposed between said second sun gear and said third ring and the second gear segments drivably engaging said second ring gear.

10. The operator of claim 9, wherein the second ring gear has $R_2$ teeth, the third ring gear has $R_3$ teeth, the first gear segments each have $S_1$ teeth, and the second gear segments each have $S_2$ teeth, and at least one of A and B is true:

$$A: R_2 \neq R_3$$
$$B: S_1 \neq S_2.$$

11. The operator of claim 10, wherein both A and B are true.

12. The operator of claim 10, wherein said second drive input comprises a motor drivably connected to the second sun gear.

13. The operator of claim 10, wherein $R_2$ is equal to $R_3$ and $S_1$ is less than $S_2$.

14. The operator of claim 1, wherein the first drive input is a worm drivably engaging the drive gear portion of the first drive gear.

15. The operator of claim 14, wherein the worm pivots about a worm axis which is substantially parallel to a plane substantially perpendicular to the central axis.

16. The operator of claim 15, wherein:

the worm includes a female socket aligned with the worm axis;

the operator is mountable beneath a sill of the window frame with the female socket exposed through a frame opening; and further comprising a handle having a male connector, said male connector being selectively extendable through said frame opening to operatively engage the worm female socket.

17. The operator of claim 1, wherein all of said gears are inherently corrosion resistant.

18. The operator of claim 17, wherein all of said gears are non-metallic.

19. The operator of claim 1, wherein said connecting means comprises a linkage secured to the first drive gear and pivotally connectable to said sash whereby pivoting of said first drive gear moves the linkage to move the sash relative to the frame.

20. An operator for controlling movement of a window sash relative to a window frame, comprising:

a first sun gear having a central axis fixed with respect to the window frame;

a first drive gear pivotable about the central axis, said first drive gear including an outer drive gear portion and an inner ring gear portion;

a first drive input operatively connected to the drive gear portion;

a planetary gear carrier pivotable about the central axis, said gear carrier including means defining planetary gear axes spaced about the first sun gear and the central axis;

a first set of planetary gears between said first sun gear and the ring gear portion of said first drive gear and pivotable about the gear axes defined by the gear carrier; and means for drivably connecting the gear carrier to the window sash whereby pivoting of the gear carrier controls movement of the sash.

21. The operator of claim 20, further comprising a second drive input operatively connected to the first sun gear for selectively rotating the first sun gear.

22. The operator of claim 21, wherein said second drive input comprises a motor drivably connected to the first sun gear.

23. The operator of claim 22, wherein the first drive input comprises a manually rotatable handle operatively connected to the drive gear portion to rotate the gear portion in response to rotation of the handle.

24. The operator of claim 21, wherein the operative connection between the second drive input and the sun gear comprises:

a second ring gear secured for pivoting with the first sun gear;

a second sun gear selectively rotatable about said central axis by said second drive input; and a second set of planetary gears between said second sun gear and said second ring gear.

25. The operator of claim 24, wherein said first ring gear and said second ring gear have substantially equal pitch diameters.

26. The operator of claim 24, wherein said second drive input comprises a motor drivably connected to the second sun gear.

27. The operator of claim 24, further comprising a third ring gear disposed about said central axis, wherein said second set of planetary gears include first and second axially spaced gear segments, the first gear segments being disposed between said second sun gear and said third ring and the second gear segments drivably engaging said second ring gear.

28. The operator of claim 27, wherein the second ring gear has $R_2$ teeth, the third ring gear has $R_3$ teeth, the first gear segments each have $S_1$ teeth, and the second gear segments each have $S_2$ teeth, and at least one of A and B is true:

$$\text{A: } R_2 \neq R_3$$
$$\text{B: } S_1 \neq S_2.$$

29. The operator of claim 28, wherein both A and B are true.

30. The operator of claim 28, wherein said second drive input comprises a motor drivably connected to the second sun gear.

31. The operator of claim 20, wherein the first drive input is a worm drivably engaging the drive gear portion of the first drive gear.

32. The operator of claim 20, wherein all of said gears are inherently corrosion resistant.

33. The operator of claim 32, wherein all of said gears are non-metallic.

34. An operator for controlling movement of a window sash relative to a window frame, comprising:

a first ring gear having $R_2$ teeth and pivotable about a central axis fixed with respect to the window frame;

means for drivably connecting the first ring gear to the window sash whereby pivoting of the first ring gear operates the sash;

a second ring gear having $R_3$ teeth and disposed about the central axis, said second ring gear being fixed with respect to the window frame;

a sun gear rotatable about the central axis;

means for selectively driving the sun gear;

a set of planetary gears having first and second axially spaced gear segments, the first gear segments having $S_1$ teeth and being disposed between said sun gear and one of said ring gears, and the second gear segments having $S_2$ teeth and drivably engaging the other of said ring gears:

wherein at least one of A and B is true:

$$\text{A: } R_2 \neq R_3$$
$$\text{B: } S_1 \neq S_2.$$

35. The operator of claim 34, wherein said first ring gear and said second ring gear have substantially equal pitch diameters.

36. The operator of claim 34, wherein both A and B are true.

37. The operator of claim 34, wherein said driving means comprises a motor.

38. The operator of claim 34, wherein $R_2$ is equal to $R_3$ and $S_1$ is less than $S_2$.

39. The operator of claim 34, wherein all of said gears are inherently corrosion resistant.

40. The operator of claim 39, wherein all of said gears are non-metallic.

41. The operator of claim 34, wherein said connecting means comprises a linkage secured to the first drive gear and pivotally connectable to said sash whereby pivoting of said first ring gear moves the linkage to move the sash relative to the frame.

42. An operator for controlling movement of a window sash relative to a window frame, comprising:

a first sun gear having a central axis fixed with respect to the window frame;

a first drive gear pivotable about the central axis, said first drive gear including a drive gear portion and a ring gear portion;

a manual drive input operatively connected to the drive gear portion;

a planetary gear carrier including means defining planetary gear axes spaced about the first sun gear and the central axis;

a first set of planetary gears between said first sun gear and the ring gear portion of said first drive gear and pivotable about the gear axes defined by the gear carrier; and means for drivably connecting the gear carrier to the window sash whereby pivoting of the gear carrier operates the sash;

a second ring gear having $R_2$ teeth and secured for pivoting with the first sun gear;

a second sun gear rotatable about said central axis;

a motor drive input for selectively rotating the second sun gear;

a third ring gear having $R_3$ teeth and fixed about said central axis;

a second set of planetary gears including first and second axially spaced gear segments, the first gear segments having $S_1$ teeth and being disposed between said second sun gear and said third ring, and the second gear segments having $S_2$ teeth and drivably engaging said second ring gear;

wherein at least one of A and B is true:

$$\text{A: } R_2 \neq R_3$$
$$\text{B: } S_1 \neq S_2.$$

43. The operator of claim 42, wherein said first ring gear and said second ring gear have substantially equal pitch diameters.

44. The operator of claim 42, wherein both A and B are true.

45. The operator of claim 42, wherein the manual drive input is a worm drivably engaging the drive gear portion of the first drive gear.

46. The operator of claim 45, wherein:

the worm pivots about a worm axis defining a plane which is substantially perpendicular to the central axis and includes a female socket aligned with the worm axis;

the operator is mountable beneath a sill of the window frame with the female socket exposed through a frame opening; and further comprising a handle having a male connector, said male connector being selectively extendable through said frame opening to operatively engage the worm female socket.

47. The operator of claim 42, wherein all of said gears are non-metallic.

48. The operator of claim 42, wherein all of said gears are plastic.

49. The operator of claim 42, wherein said connecting means comprises a linkage secured to the first drive gear and pivotally connectable to said sash whereby pivoting of said first drive gear moves the linkage to move the sash relative to the frame.

* * * * *